United States Patent [19]

O'Farrell, Jr.

[11] 4,095,124

[45] June 13, 1978

[54] TRANSFORMER/SWITCH DEVICE

[76] Inventor: John J. O'Farrell, Jr., 2525 N. Alvernon Way, C-6, Tucson, Ariz. 85712

[21] Appl. No.: 714,314

[22] Filed: Aug. 16, 1976

[51] Int. Cl.[2] ..... H01H 43/00

[52] U.S. Cl. ..... 307/141.4; 361/210; 335/268

[58] Field of Search ..... 307/141, 141.4, 141.8, 307/112, 113, 114, 115; 361/143, 189, 191, 210, 206; 335/135, 268

[56] References Cited

U.S. PATENT DOCUMENTS

| | | | |
|---|---|---|---|
| 2,801,374 | 7/1957 | Svala | 361/210 |
| 3,662,186 | 5/1972 | Karklys | 307/141 |
| 3,689,806 | 9/1972 | Saita | 307/10 LS |
| 3,774,056 | 11/1973 | Sample et al. | 307/141 |
| 3,790,815 | 5/1974 | Karklys | 307/141 |
| 3,826,955 | 7/1974 | Fest | 361/196 |

*Primary Examiner*—Robert K. Schaefer
*Assistant Examiner*—Morris Ginsburg
*Attorney, Agent, or Firm*—Cahill, Sutton & Thomas

[57] ABSTRACT

An electrical device in which a transformer and switch are cooperatively integrated, the magnetic field of an energized primary winding of the transformer performing the dual function of (1) energizing a magnetically coupled secondary winding to generate an induced voltage to power associated circuitry, and (2) determining the state of the switch. The associated circuitry may be control circuitry for controlling energization of a primary winding, or for changing the path or presence of the magnetic flux created by the energized primary winding electromagnetic field; or it may perform general functions such as indicating the state of energization of a primary winding, or of the state of the responsive switch or associated devices.

21 Claims, 7 Drawing Figures

TRANSFORMER/SWITCH DEVICE

This invention relates to an electrical device, and in particular to an electrical device for providing combined transformer and switching functions.

At this stage of the electronic age, it is apparent that many of the developments in this field could be utilized to a far greater extent if the cost of the electrical devices or components could be reduced. In other words, while the technology has advanced substantially, the cost of the hardware has not been concomitantly reduced. There is a constant search for ways in which to reduce cost. One way in which to accomplish this result is to provide electrical components which perform multiple functions. Another, and related way, is to reduce the size of components. The present invention achieves these goals by cooperatively combining two individually common components of electrical circuits, namely, a transformer and a switch. By so doing, the physical size and weight of a particular electrical device embodying such components may be reduced without any sacrifice in capability. Patents relating to the present invention include U.S. Pat. Nos. 3,662,186; 3,689,806; 3,774,056; 3,790,815; and 3,826,955.

A principal object of this invention is to provide an electrical device integrating transformer and switching functions.

A further object is to provide an integrated transformer and switch wherein the transformer powers electrical circuitry coupled to the switch.

A still further object is to provide an integrated transformer and switch wherein the transformer powers electrical circuitry independent of the switch.

These and other objects which will become apparent hereinafter are provided by an electrical device including transformer means comprising primary and secondary means magnetically coupled to provide electrical energy pulses upon energization of the primary means, and switching means having a first component comprising the primary means of the transformer means, and a second component comprising responsive means responsive to the magnetic field generated by the primary means, whereby the state of the switching means is determined, and electrical circuitry means electrically coupled to the transformer means for energization by such transformer means. The electrical circuitry may produce a signal which controls further energization of the primary means, or it may produce conditions which control the responsive means by changing the path or presence of the magnetic flux influencing the responsive means. Alternately, the electrical circuitry may be independent of the primary or responsive means in the sense that the output of the circuitry does not influence the primary or the responsive means.

BRIEF DESCRIPTION OF THE DRAWING

Drawings are provided wherein:

Referring to FIG. 1, there is shown a portion of a housing 10 for supporting transformer/switch device 12 of the present invention. A transformer 14 includes an insulating bobbin 16 surrounding a magnetic core 18 mounted on conventional relay bracket 20. In various embodiments, the core may be an air core or it may be composed of a high permeability metal, such as iron. Wound on the bobbin 16 are primary winding 22, secondary winding 24, and an auxiliary primary winding 26. The windings are insulated from one another by insulating washers 28 mounted upon bobbin 16. A third insulating washer 30 is positioned above winding 22. A shading coil may or may not be required. Pairs of electrical leads 34, 36 and 38 extend from windings 22, 24 and 26, respectively. In this embodiment, it will be assumed that coil 22 is the primary winding of the transformer and winding 24 is the secondary winding. The ratio of turns of primary winding 22 and secondary winding 24 will depend upon the incoming voltage across the primary winding 22 and the electromotive force (emf) desired to be induced in the secondary winding 24 by mutual inductance. In a particular embodiment, the ratio of the number of turns of primary winding 22 and secondary winding 24 is 10:1 such that a 10:1 step-down transformer is provided. Winding 26 is employed as a remotely controlled actuating coil to provide an alternate means of initially actuating the associated relay to the manual means as described hereinafter.

Figure 1:
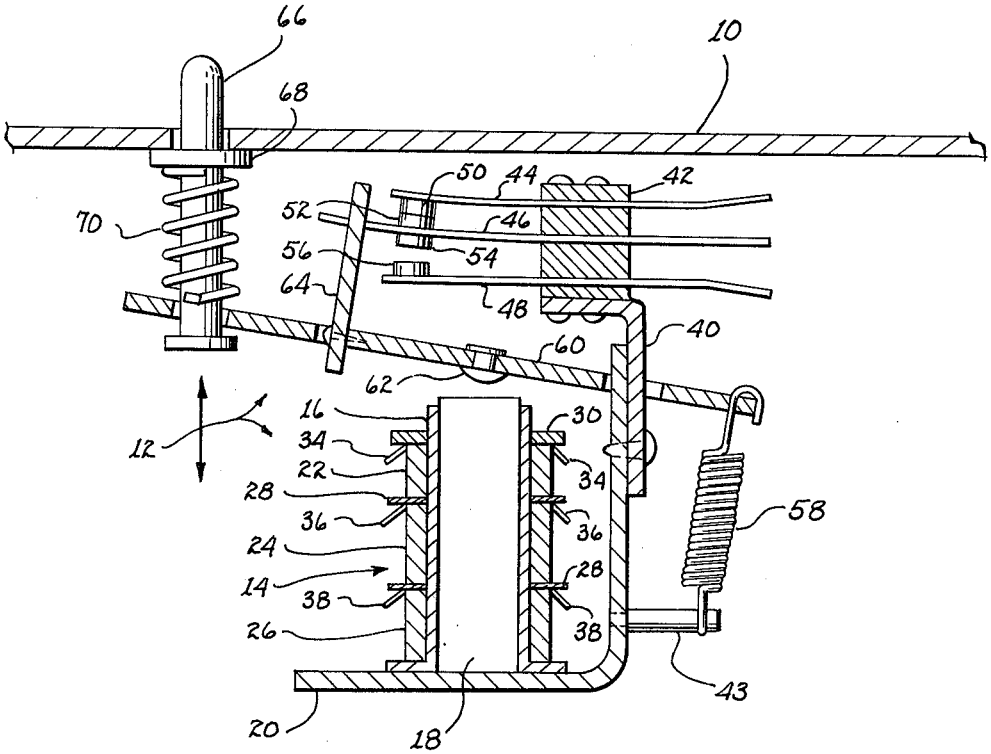
FIG. 1 is a crossectional view in elevation of a transformer/switch of the present invention.

To the upright portion of relay bracket 20 is attached a bracket 40. Mounted by screws or the like to bracket 40 is insulator 42 having slots through which pass electrically conductive relay leaves 44, 46 and 48. Leaf 44 has an electrical contact 50; leaf 46 has a pair of electrical contacts 52 and 54; and, leaf 48 has an electrical contact 56. Contacts 50, 52, 54 and 56 may be made of any conventional material, i.e. tungsten. An armature 60 is pivotally mounted on relay bracket 20. Fixedly attached to a post 43 extending from relay bracket 20 is one end of an armature spring 58. The other end of spring 58 is attached to one end of armature 60. Intermediate the ends of armature 60 is an insulating contact button 62 which, upon counterclockwise movement of the armature, first contacts core 18 to maintain an air gap between the armature and the core. An insulating arm 64 extends upwardly from the armature and is attached to the flexing end of leaf 46. A spring loaded manual actuator 66 extends from the end of armature 60 to a point exterior of housing 10. Between stop member 68, mounted on actuator 66, and armature 60, is spring 70.

The operation of the embodiment of the invention depicted in FIG. 1 is as follows. The manual actuator 66 is depressed causing armature 60 to move downward toward core 18 to break the electrical path between contacts 50 and 52 and establish an electrical path between contacts 54 and 56. Closing contacts 54 and 56 causes primary winding 22 to be energized by a power source (not shown) to provide an induced emf in secondary winding 24. Energization of primary winding 22 establishes an electromagnetic field to draw armature 60 toward core 18 until button 62 contacts the core. Upon cessation or reduction of power to coil 22 resulting in a decreased electromagnetic field acting upon relay armature 60, armature 60 returns to its unactuated position; concurrently, the electrical path between contacts 54 and 56 will be broken and the electrical path between contacts 50 and 52 will be reestablished.

Figure 2:
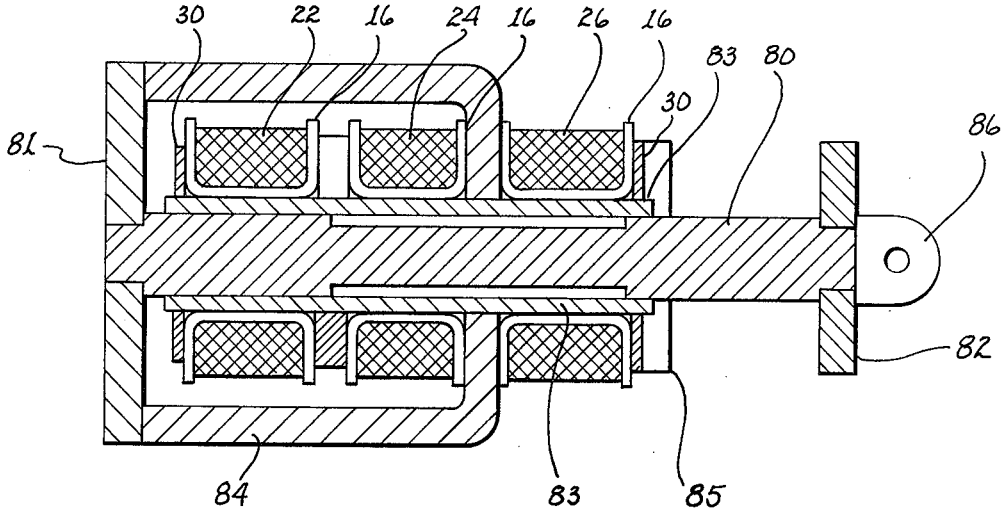
FIG. 2 is a crosssectional view of a variant of the transformer/switch illustrated in FIG. 1.

The embodiment of FIG. 2 includes an armature shaft 80 on one end of which is integrally mounted an armature 81 and on the other end of which is integrally mounted an armature 82. Surrounding armature shaft 80 is a non-conductive sleeve 83. Three transformer windings are wrapped on bobbins 16; a first primary winding 22, a secondary winding 24, and a second primary winding 26. Associated with armature 81 is a core 84 common to windings 22 and 24; associated with armature 82 is a core 85 common to windings 26 and 24. Connected to armature 82 is ear 86 which is mechanically linked to a vlave or other element not shown.

Figure 3:
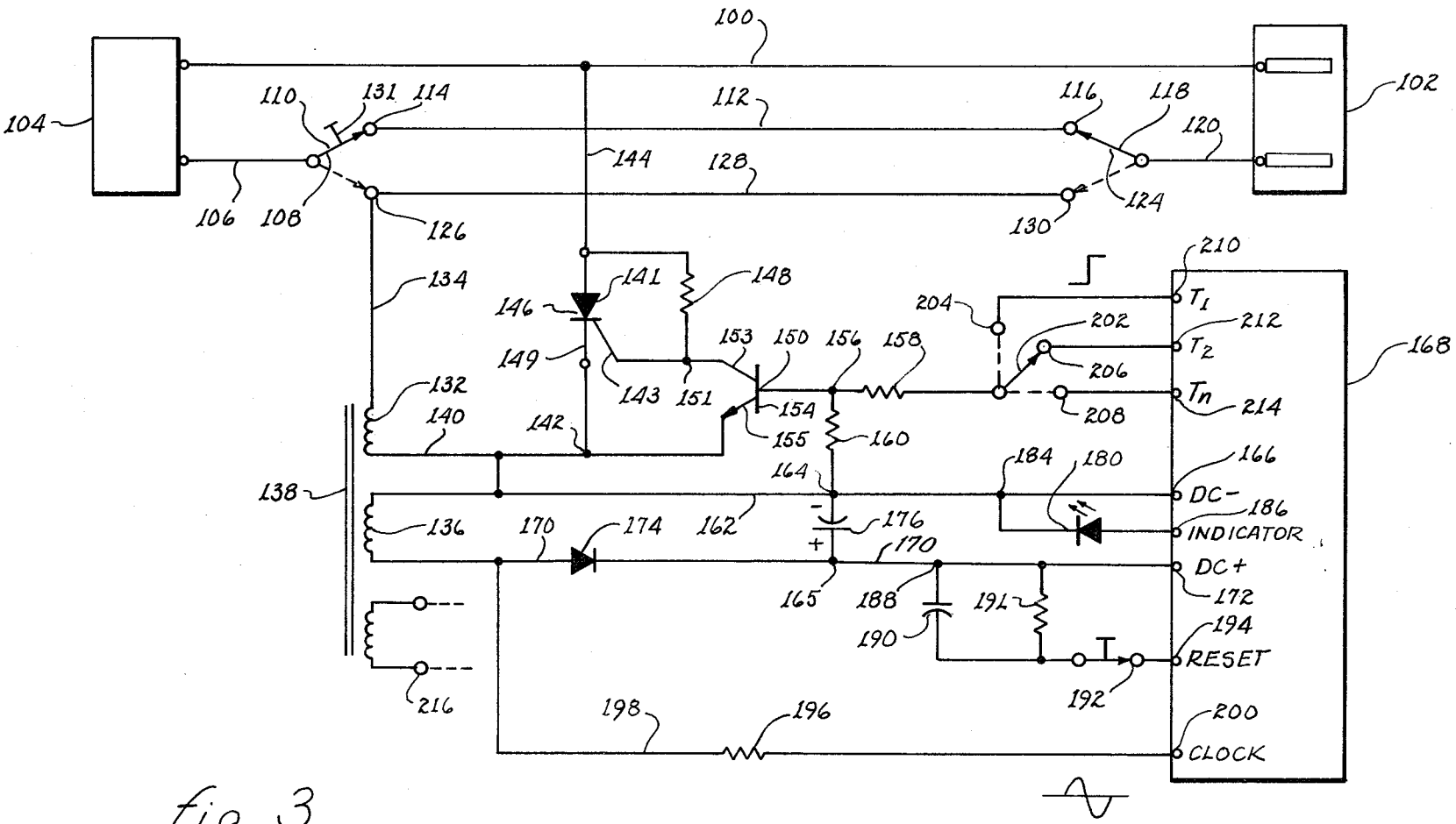
FIG. 3 is a schematic diagram of an electrical timer circuit incorporating the present invention.
Figure 4:
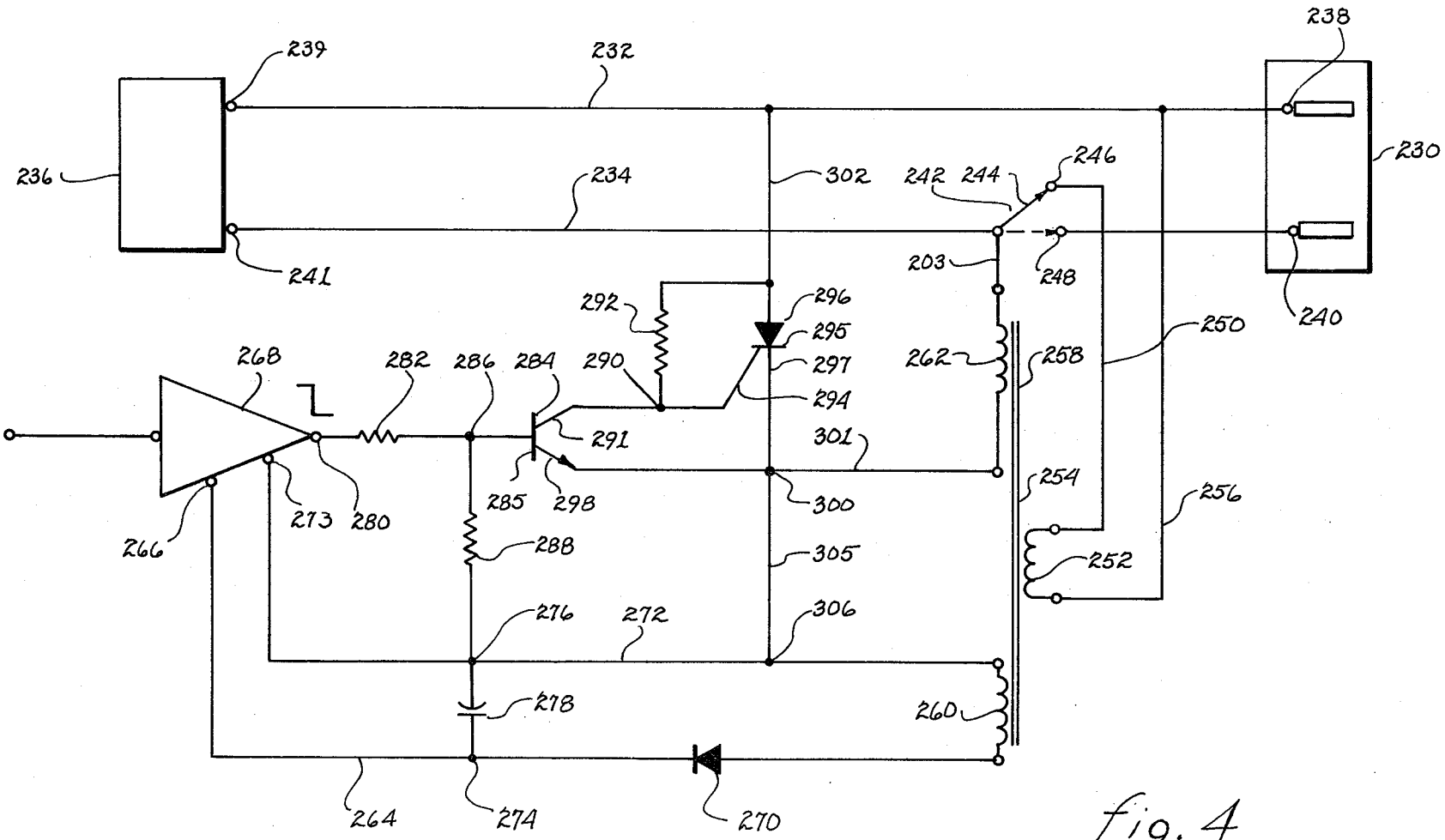
FIG. 4 is a schematic diagram of another electrical control circuit incorporating the present invention.

The embodiment of FIG. 2 operates in the following manner. Upon energizing primary winding 22, a magnetic field is generated which produces lines of magnetic flux in armature shaft 80, armature 81, and core 84 sufficient to attract armature 81 towards core 84. The armature shaft 80 is drawn into sleeve 83 until armature 81 closes the gap with core 84; at the same time armature 82 is moved away from core 85. During energization of primary winding 22, the magnetic field so provided generates an induced emf in the secondary winding 24. When, due to the action of control circuitry such as is shown in FIGS. 3 and 4, primary winding 22 is deengerized, and a second primary 26 is energized, a magnetic field is now produced in armature shaft 80, armature 82, and core 85 sufficient to attract armature 82 toward core 85. Armature shaft 80 now moves in the opposite direction from the above, until armature 82 closes the gap with core 85; at the same time moving armature 81 away from core 84. While primary winding 26 is energized, its magnetic field continues to generate an induced emf in the secondary winding 24 common to both primary windings 22 and 26. This reciprocating movement of the common armature shaft/armatures may be transmitted to other mechanisms to perform mechanical and/or electical switching either directly or through mechanical linkage connected to ear 86.

Any conventional transformer or relay coil construction may be employed in the practice of this invention. Primary and secondary windings may be provided by separate windings or a single winding with appropriate taps to achieve the desired turns ratio as in an autotransformer. In addition to having windings which are sequentially wound along the transformer core in axially spaced relationship or concentrically spaced relationship, the primary and secondary windings may be interleaved in an electrically insulated relationship, i.e., bifilar windings.

The device of FIG. 1 may be considered as having two major components, one a transformer 14 made up of primary winding 22, secondary winding 24 and core 18 (plus the conventional leads required to energize the primary winding 22 and conduct the emf of mutual induction from secondary winding 24) and the other a switch component composed of primary winding 22 and the combination of means responsive to the magnetic field generated by the primary winding 22, viz., armature 60 and relay leaves 44, 46 and 48 and their associated contacts.

The device of FIG. 2 may also be considered as having two major components; a first transformer made up of primary winding 22, secondary winding 24, and core 84, and a second transformer composed of core 85, primary winding 26 and secondary winding 24 common to both primary windings; and the other, a switch component composed of primary windings 22 and 26 and the combination of means responsive to the magnetic field generated by a primary winding when it is energized; namely, armature shaft 80 and armatures 81 and 82.

FIG. 3 represents electrical circuitry powered by the embodiment of FIG. 1 to provide a signal controlling further energization of the primary winding associated with the switch component. A conductor 100 connects one terminal of load circuit 102 to one terminal of suitable power source 104. A second conductor 106 from other terminal of power source 104 is connected to the moveable contact 108 of switch 110. Conductor 112 extends between normally closed contact 114 of switch 110 and normally closed contact 116 of switch 118. Conductor 120 connects another terminal of load circuit 102 to moving contact 124 of switch 118. Normally open contact 126 of switch 110 is connected by conductor 128 to a normally open contact 130 of switch 118. One end of transformer primary winding 132 is connected via conductor 134 to contact 126. Primary winding 132 is in magnetically coupled relationship to transformer secondary winding 136. The transformer includes a common core 138. Conductor 140 connects one lead of primary winding 132 with junction 142. Anode 141 of a semi-conductor switch or thyristor 146 [such as a silicon controlled rectifier (SCR) (GE106B)] is connected to conductor 100 by conductor 144; cathode 149 of the SCR is connected to junction 142. A resistor 148 is provided between the anode 141 and gate 143 of SCR 146. Collector 153 of transistor 150 (2N 3904) is connected to junction 151 between resistor 148; emitter 155 of transistor 150 is commonly connected to junction 142. Base 154 of transistor 150 is connected at junction 156 to resistors 158 (2700 ohms) and 160 (5600 ohms). Resistor 160 is connected to the DC (−) conductor 162 of the secondary winding 136 at junction 164. Conductor 162 extends from secondary coil 136 through junction 164 to the negative DC terminal 166 of timer control circuit 168. Conductor 170 from the secondary coil 136 is connected to the positive DC terminal 172 of control circuit 168 through diode rectifier 174 (IN 4002) and junction 165. Between junctions 164 and 165 is located a polarized filter capacitor 176 (1000 microfarads). A photo-emissive diode (P2003) 180 is connected between DC(−) conductor 162 at junction 184 and control circuit 168 at indicator terminal 186. Tapped from conductor 170 at junction 188 is a reset circuit including capacitor 190 (0.01 microfarad), resistor 191 (1 megohm), and manual reset 192 connected to reset terminal 194 of control circuit 168. Conductor 198 interconnects resistor 196 (100 K ohms) intermediate conductor 170 and clock terminal 200 of control circuit 168. Switch 202 is connected to resistor 158. Contacts 204, 206 and 208 are connected to output terminals 210, 212 and 214, respectively, of time control circuit 168. Remote actuator coil 216, also wound around core 138, is electrically isolated from the remainder of the circuit.

The circuit of FIG. 3 operates as follows. Conductors 100 and 106 are connected to AC power source 104 and load circuit 102 is connected to conductors 100 and 120. Switch 118 is set as desired in the accordance with the following discussion. Manual actuator 131 is then pressed down to reposition moveable contact 108 from its normally closed (NC) position associated with stationary contact 114 to its normally opened position (NO) associated with contact 126. Alternatively, remote actuator coil 216 may be energized through a separate circuit (not shown) which includes a normally open switch and a source of power to energize coil 216 when that respective switch is closed, causing contact 108 to be magnetically moved to contact 126, as described above in accordance with embodiment of FIG. 1, for example.

Upon throwing switch 110 as described, SCR 146 becomes electrically conductive on the next AC cycle because its anode 141 and gate 143 are at the same positive potential and transistor 150 is not conducting. Primary winding 132 is energized through the SCR to hold switch 110 in the actuated position and generate an emf by mutual induction in secondary winding 136. This induced voltage in winding 136 is rectified and filtered by rectifier 174 and capacitor 176 to provide DC power to timer control circuit 168 via junctions 164 and 184 and junctions 165 and 188. Power is also supplied to the reset circuit (capacitor 190 and resistor 191) creating a pulse which automatically sets the timer at zero. Resistor 191 then discharges capacitor 190 so that a second reset impulse can be transmitted at a later time. Manual reset 192 may also be actuated to reset the timer to zero at any time, if desired. Thereafter, AC pulses emanating from secondary winding 136 are conducted via conductors 170 and 198 through resistor 196 to clock terminal 200 for counting. Upon reaching a predetermined count, that terminal (210, 212 or 214) changes from DC (−) to DC (+), causing a voltage to be applied to switch 202 through resistors 158 and 160 across the base 154 and emitter 155 of transistor 150. Transistor 150 begins conducting between collector 153 and emitter 155 causing gate 143 to achieve the same potential as cathode 149. SCR 146 then ceases conducting on the next AC cycle. Current to primary winding 132 is thus interrupted causing primary winding 132 to be de-energized. DC power to control circuit 168 is terminated and the latter stops counting. In addition, the magnetic field created by primary winding 132 collapses causing contact 108 of switch 110 to return to contact 114. If switch 118 is in the position shown in full line (116/118), the release of switch 110 to the NC position results in applying power to the load circuit 102. If switch 118 was initially in the position shown in dotted line (118/130), the release of switch 110 to the NC position results in interrupting power to the load circuit 102. The photoemissive diode 180 serves only as a visual indicator that the timer control circuit 168 is operating.

Referring to FIG. 4, a load circuit 230 having terminals 238 and 240 is connected through conductors 232 and 234 to suitable power source 236 having terminals 239 and 241. Along conductor 234 is positioned a switch 242 having a moving contact 244 and stationary contacts 246 and 248. Stationary contact 248 is connected to terminal 240 and stationary contact 246 is connected via conductor 250 to one lead of a primary winding 252 of a transformer generally designated by the numeral 254. The other lead of primary winding 252 is connected via conductor 256 to conductor 232. This circuit applies AC or equivalent power across primary winding 252. The magnetic field produced by primary winding 252 is not of sufficient strength to actuate contact 244. Transformer 254 also includes a common core 258, a secondary winding 260, and a second primary winding 262. Conductor 264 extends from secondary winding 260 to the positive DC terminal 266 of amplifier/trigger 268. Intermediate the ends of conductor 264 is located a rectifier (IN 4002) 270. The other end of the secondary winding 260 is connected to the negative DC terminal 273 of emplifier/trigger 268 via conductor 272. Between junctions 274 and 276 of conductors 264 and 272, respectively, is located filter capacitor 278 (1000 microfarad). The output terminal 280 of amplifier 268 is connected to resistor 282 (2700 ohms), which in turn is connected to the base 285 of transistor 284 at junction 286. Between junction 286 and junction 276 is located resistor 288 (5600 ohms). The collector 291 of transistor 284 is attached at junction 290 to resistor 292 (22 K ohms) and the gate 294 of SCR 295 (GE 106 B). Resistor 292 is in turn attached to the anode 296 of SCR 295. Cathode 297 of SCR 295 attaches to the emitter 298 of transistor 284 at junction 300 and also to primary winding 262 through conductor 301 and to the negative side of the secondary winding 260 through conductor 305 at junction 306. SCR 295 is in series with primary winding 262 across the power source 236 through conductor 302 between anode 296 and conductor 232 and conductor 203 between primary 262 and AC conductor 234.

The operation of the circuit of FIG. 4 is as follows. It is assumed that contact 244 of switch 242 is in the position shown in full line, i.e., in contact with (NC) contact 246. Upon application of power from power source 236, voltage is applied to primary winding 252 causing an emf to be generated in secondary winding 260 through mutual inductance. The induced voltage is rectified and filtered through rectifier 270 and filter capacitor 278 to provide DC power to amplifier/trigger 268. SCR 295 is in a non-conducting mode at this stage because transistor 284 is biased to conduct between its collector 291 and emitter 298 when power is first applied. This causes gate 294 and cathode 297 to be at the same potential, preventing conduction in the SCR 295. Upon injection of a control signal by amplifier 268 through resistors 282 and 288 across the base 285 and emitter 298 of transistor 284, transistor 284 ceases conducting allowing the gate to rise to the voltage of anode 296. The SCR 295 will thus conduct on the next AC cycle, causing primary winding 262 to be energized. A magnetic field of sufficient strength and phase is produced by energizing primary winding 262 to actuate contact 244 as described above, causing contact 244 to switch from contact 246 to contact 248. Load circuit 230 is now connected to the power source 236 and an open circuit is created to primary winding 252. Transformer action between primary winding 252 and secondary winding 260 ceases; however, transformer action now occurs between primary winding 262 and secondary winding 260 to provide DC power continuously to amplifier 268 as described above. Upon injection of the next control signal into amplifier 268, transistor 284 again becomes conductive and SCR 295 ceases conducting on the next AC cycle, opening the circuit to primary winding 262. The magnetic field produced by primary winding 262 collapses and consequently contact 244 returns to the NC position shown in full line, i.e., in contact with contact 246. Power to the load circuit is now interrupted and primary winding 252 is reenergized. Transformer action now occurs between primary winding 252 and secondary winding 260 as explained above to continue to provide DC power to amplifier 268.

The electromagnetic structure of the relay/transformer may also be such that the magnetic fields of primary winding 252 and primary winding 262 are equal but applied to opposite sides of an armature controlling the contact 244. Therefore, when primary winding 252 is energized contact 244 moves to contact 246. When primary winding 262 is energized, contact 244 moves to contact 248. When neither primary is energized, contact 244 is positioned midway between the two stationary contacts by the biasing action of retractile springs and/or contact leaves. When either primary winding is energized, an emf is induced in the secondary winding 260 to power the control and/or other circuits. If transistor 284 is initially biased to cut off when power is applied, this allows SCR 295 to conduct and energize primary 262. This causes contact 244 to close with contact 248, applying power to load 230.

The control circuitry for primary winding 252 and primary winding 262 may be similar, so that either or both primary windings could be controlled by low level signals. Switch 242 may then only be used for applying and removing power to the load 230. Switch 242 may be eliminated altogether if the only purpose of the means responsive to the primary magnetic field is to perform mechanical or other work via the force and/or movement produced by that response (see FIG. 2). The transfer of energy from one primary winding to another primary winding, or the energization and deenergization of a primary winding can be accomplished at near the zero voltage point of the AC cycle, or DC pulse, by using a zero voltage switching circuit as part of each SCR controlling circuit.

Figure 5:
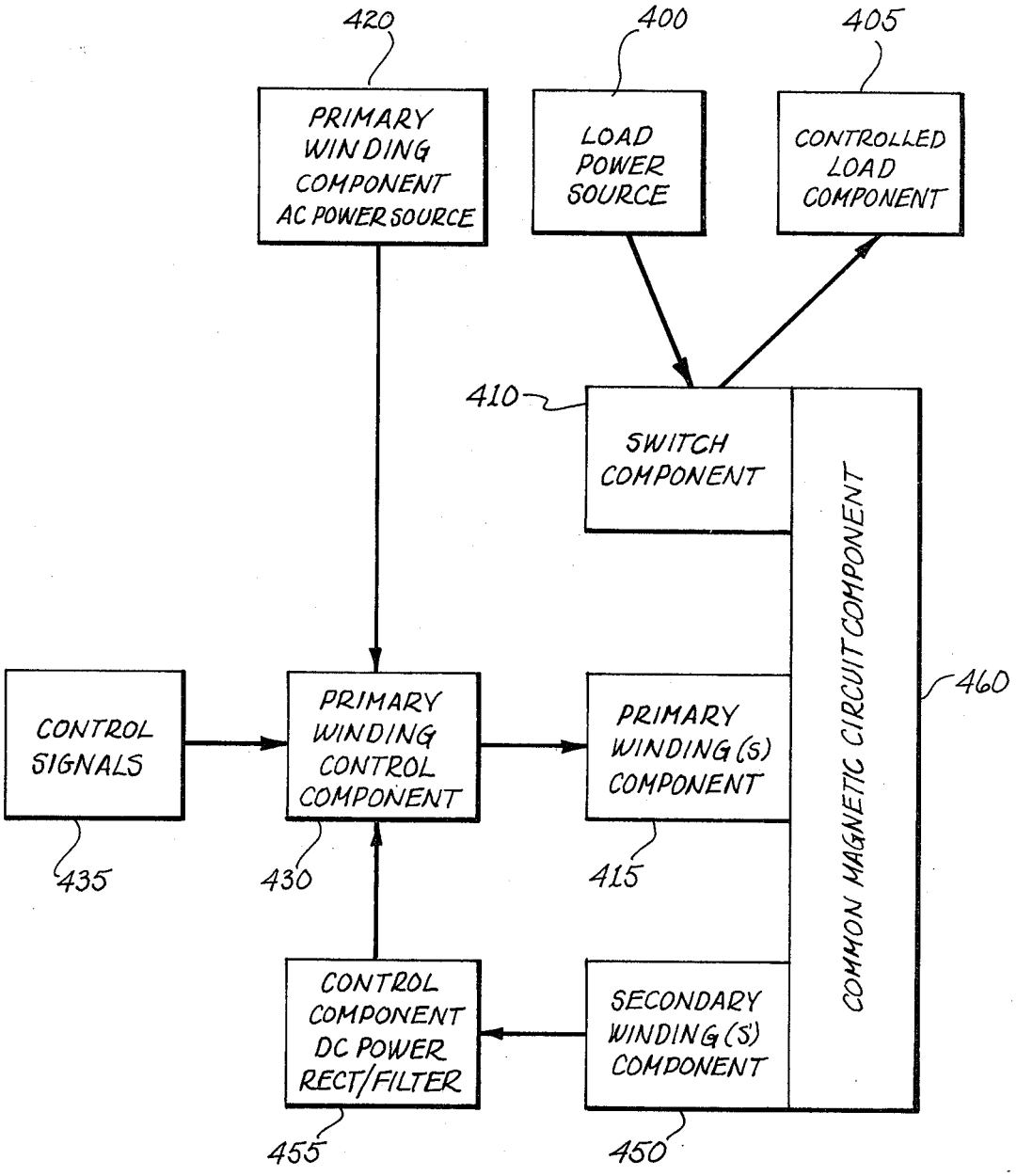
FIG. 5 is a block diagram of a further electrical circuit incorporating the present invention.

FIG. 5 represents a logic diagram illustrating use of the transformer/switch of the present invention. A load power source 400 provides power to a controlled load component 405 through switch component 410. The latter is that component of the switch which is responsive to the magnetic field produced by primary winding(s) component 415. A further power source designated as the primary winding component source 420 may be provided as a separate element of this function may also be provided by load power source 400 (see e.g., the circuit of FIG. 3).

The power for the primary winding(s) component 415 passes through a primary winding control component 430 to which is also fed a suitable control signal from control signal component 435. The AC or pulsating DC current emanating from primary winding control component 430 energizes primary winding(s) component 415 producing current by mutual induction through secondary winding(s) component 450. The current is rectified/filtered through DC power rectifier/filter component 455 and then fed into primary winding control component 430. Associated with the primary and secondary transformer windings 415 and 450, respectively, and switch component 410 is a common magnetic circuit component 460, typical of which is the magnetically permeable iron core of a transformer.

Figure 6:
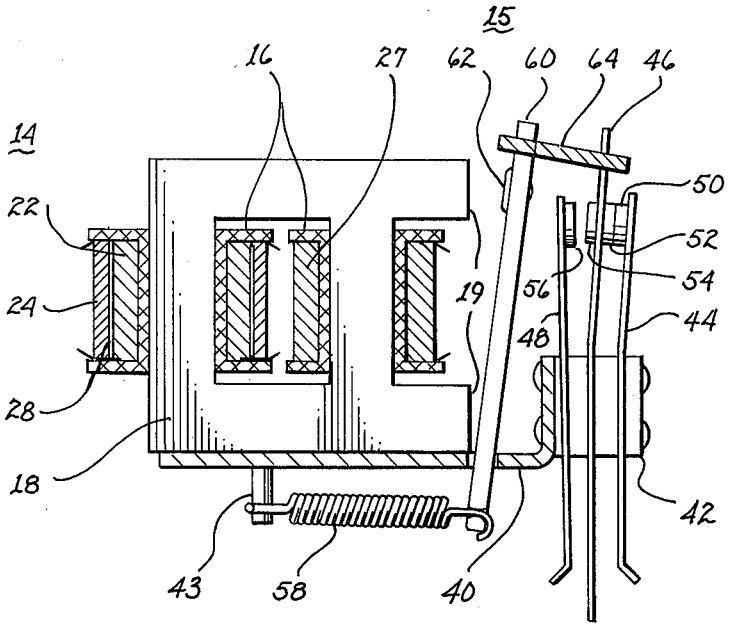
FIG. 6 is a cross-sectional view of a variant of the transformer/switch of the present invention.

The embodiment of FIG. 6 includes a transformer 14, which comprises an insulated bobbin 16 surrounding one leg of a common magnetic structure 18. Concentrically wound on this bobbin 16, and insulated from each other by insulator 28, are a primary winding 22, and a power secondary winding 24.

A switch component 15, is provided including control secondary winding 27 wound on a second bobbin 16 surrounding a second leg of the common magnetic structure 18, and an armature 60 pivotally mounted across the pole faces 19 of the common magnetic structure 18. To the magnetic structure 18 is also attached a bracket 40, and mounted to this bracket 40 are insulators 42, relay leaves 44, 46, and 48, and contacts 50, 52, 54, and 56. An insulating arm 64 extends from one end of the armature 60, and is also attached to the flexing end of leaf 46. A spring 58 is fixedly attached to a post 43 on bracket 40, and the other end of spring 58 is attached to the other end of armature 60.

The device of FIG. 6 may be considered as having two major components; (1) a power transformer composed of primary winding 22, secondary winding 24, and magnetic structure 18, and (2) switch 15 composed of a combination of primary winding 22, magnetic structure 18, control secondary winding 27 and armature 60 and its associated switch leaves and contacts.

Figure 7:
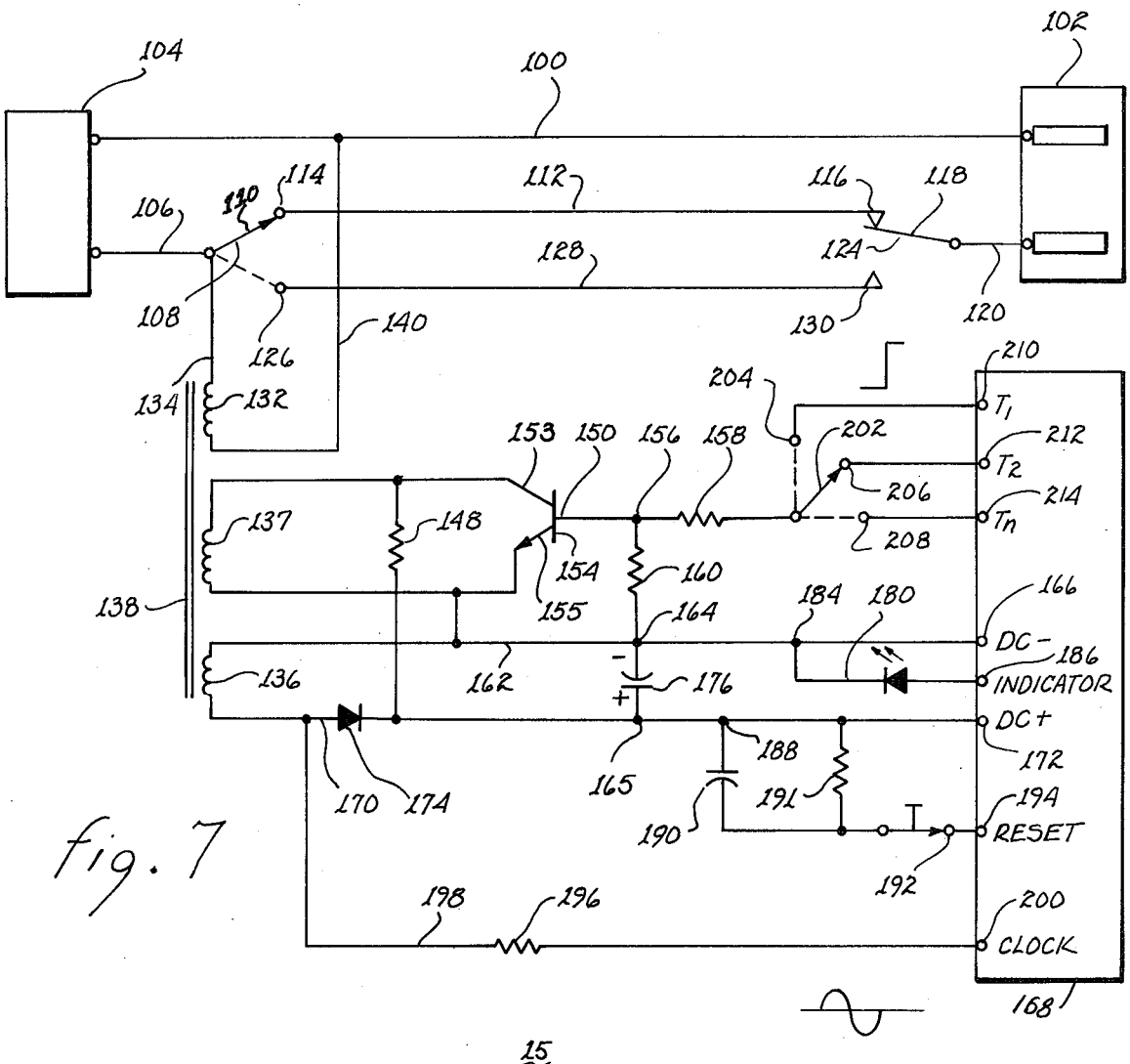
FIG. 7 is a schematic diagram of an electrical control circuit incorporating the embodiment of FIG. 6.

FIG. 7 represents electrical circuitry powered by the transformer action of the embodiment of FIG. 6 to provide a signal controlling the switch component without interrupting the primary circuit, or the power secondary function. This circuitry is identical to that shown in FIG. 3 with the exceptions noted. Primary winding 132 (corresponding to primary winding 22 of FIG. 6) is now connected directly across the power source 104 at all times, via conductors 134 and 140 which are connected to conductors 106 and 100 respectively. Switch 110 now assumes the function performed by switch 118 in the embodiment of FIG. 3 and switch 118 performs the function of switch 110 in FIG. 3. Control secondary winding 137 is connected between collector 153 and emitter 155 of transistor 150. Resistor 148 is provided between collector 153 and the DC positive side of diode 174. Power secondary winding 136 now provides power at all times to timer 168 and control transistor 150, regardless of the condition of the control circuitry and control secondary winding 137.

The embodiment of FIG. 6 operates in the following manner. Upon energizing primary winding 22 with AC or pulsating DC power by placing it directly across the source of power, a magnetic field is generated which produces varying lines of magnetic flux in the common magnetic structure 18. This flux generates an induced EMF in both the power secondary winding 24, and in the control secondary winding 27. The current flowing in the power secondary winding 24 energizes the electrical/electronic circuitry associated with secondary winding 136 as shown in FIG. 7.

So long as the level of current flowing in control secondary winding 27 and its associated control circuitry shown in FIG. 7 is zero, or a very low value, the lines of flux will continue to follow the path of low reluctance, through that leg of the common magnetic structure on which control secondary winding 27 is placed, rather than take the alternate path of higher reluctance provided by the magnetic structure, pole faces 19, armature 60, and the intermediate air gap. When, due to the action of control circuitry such as is shown in FIG. 7, control secondary winding 137 is shunted with a low resistance, a significant level of current flows in the control secondary winding 27. This current generates an opposing flux in that leg of the common magnetic structure, which substantially increases its reluctance to the flow of flux generated by primary winding 22. That flux is thereby redirected to the alternate path through the pole faces, air gap and armature, sufficient to cause the armature to be attracted toward the pole face in a counter-clockwise movement until stopped by residual button 62 contacting the pole face. This responsive movement of the armature is transmitted through insulating arm 64, operating the contact leaf 46. When the control secondary winding circuit is changed again to a high resistance, the current in the winding is again reduced to a level that reduces the opposing flux and reluctance of that leg of the magnetic structure to the normal value. This allows the original flux path to be restored. The armature 60 is released and returned to its normal position by spring 58, and relay contact leaf 46 is then also restored to its normal position.

It is to be noted that at all times the induced emf in the power secondary winding 24 is not disturbed, and is continually available to energize the associated circuitry since the current flowing through primary winding 22 is not interrupted.

The circuit of FIG. 7 operates as follows: Conductors 100 and 106 are connected to AC power source 104 and load circuit 102 is connected to conductors 100 and 120. Switch 110 is set as desired, in accordance with the following discussion.

Primary winding 132 is continuously energized, and generates an emf by mutual induction in power secondary winding 136. This voltage is rectified and filtered by rectifier 174 and capacitor 176 to provide DC power to timer control circuit 168 via junctions 164 and 184 and junctions 165 and 188. Power is also supplied to the reset circuit (capacitor 190 and resistor 191) creating a pulse which automatically sets the time to zero. Resistor 191 then discharges capacitor 190 so that a second reset impulse can be transmitted at a later time. Manual reset 192 may be also actuated to reset the timer to zero at any time if desired.

Thereafter, AC pulses emanating from secondary winding 136 are conducted via conductors 170 and 198 through resistor 196 to clock terminal 200 for counting. Upon reaching a predetermined count, that terminal (210, 212, or 214) changes from DC(−) to DC(+) causing a voltage to be applied to switch 202 thru resistors 158 and 160 across the base 154 and emitter 155 of transistor 150. Transistor 150 begins conducting between collector 153 and emitter 155 causing the resistance across the control secondary winding 137 to drop substantially which in turn causes substantial current to flow through the control secondary winding 137. The counter emf induced in winding 137 by this current generates a magnetic flux in that leg of the magnetic structure opposite in polarity to the flux created by the primary winding 132. This raises the reluctance of this magnetic path, causing the flux of primary winding 132 to take the alternate path across pole faces 19 of the magnetic structure, and through the armature 60 thereby changing the state of the switch component 118. Contact 124 of switch component 118 moves from closed contact 116 (NC) to open contact 130(NO). If switch 110 had been set in the position shown by the solid line, actuation of switch 118 removes power from the load circuit 102. If switch 110 had been set in the position shown by the broken line, actuation of switch 118 applies power to the load circuit 102.

The timer circuit 168 may be an electronic alarm clock. Upon reaching a preset alarm time, the resultant alarm signal may be used to actuate transistor 150, as described above. The photoemissive diode 180 serves only as a visual indicator that the clock or timer circuit 168 is operating. Additional display circuitry (not shown) may be used to display the time of day, alarm time setting, and the like.

At such time as the timer circuit is reset, and the signal from terminal (210, 212 or 214) changes from DC(+) to DC(−), transistor 150 ceases conducting, and the current in control secondary winding 137 (corresponding to winding 27 in FIG. 6) again is reduced to near zero. This reduces the magnetic reluctance through that leg of magnetic structure 18 surrounded by control secondary winding 137, allowing the flux of primary coil 132 to again take this path, releasing armature 60 and allowing return to its original state. Switch contact 124 of switch 118 returns to its closed contact 116(NC).

The transformer component of the invention herein described may be employed to energize electrical circuitry which controls further energization of the primary winding associated with the switch component. Circuitry exemplifying such an embodiment is shown schematically in FIGS. 3 and 4. Alternately, the transformer component of the invention herein described may be employed to energize electrical circuitry which controls the state of the responsive means associated with the primary winding and switch component, without interrupting the continuous energization of the primary winding. The transformer component may also be employed to power electrical circuitry having a function not effecting energization of the primary, or the response of the switch component, e.g., an audio or visual signal indicating whether the transformer is energized or not, or the state of the responsive means. The element of the switch component of the device of this invention responsive to the magnetic field of the primary winding may be electrically, electronically, magnetically, or mechanically responsive. In addition to the elements described above, the element may be, for example, a beam of electrons or other electronic devices such as Hall-effect semiconductors. As will be appreciated, the embodiments herein described are representative and not limiting of the invention.

What is claimed is:

1. An integrated transformer and switch device for controlling the flow of electrical power from a power source to a load, said device comprising:

a. a transformer means including a primary winding means electrically energizable by the power source for generating a magnetic field and a secondary winding means for generating an output signal, said secondary winding means being magnetically responsive to the magnetic field generated by said primary winding means;

b. first switch means having a normally closed state and a normally open state for supplying power to said primary winding means, said first switch means being maintained in the normally open state during energization of said primary winding means;

c. second switch means in series with said primary winding means for maintaining a flow of power through said primary winding means upon switching of said first switch means to the normally open state, said second switch means having a conducting state and a non-conducting state;

d. a selectively positionable third switch means for electrically connecting the load to the power source, said third switch means having a first state electrically connecting the load to the power source when said first switch means is in the normally closed state and the second state electrically connecting the load to the power source when said first switch means is in the normally open state;

e. fourth switch means responsive to the electrical energy pulses provided by said secondary winding means for changing said second switch means from the conducting state to the non-conducting state;

whereby, dependent upon the state of said third switch means, the load is connected or disconnected from the power source upon actuation of said first switch means and the load is disconnected or connected to the power source upon actuation of said fourth switch means.

2. The device as set forth in claim 1 including a further secondary winding means for providing electrical energy pulses to ancillary equipment.

3. The device as set forth in claim 1 wherein said first switch means is a mechanically operated switch.

4. The device as set forth in claim 3 wherein said second switch means is an active electric element having a conducting state and a non-conducting state.

5. The device as set forth in claim 4 wherein said third switch means is a relay switch.

6. The device as set forth in claim 5 wherein said fourth switch means is a timer initiated by energization of said secondary winding means, said timer including means for generating a signal to switch said active element from a conducting state to the non-conducting state.

7. The device as set forth in claim 6 wherein said generating means includes a transistor.

8. The device as set forth in claim 7 including selectable timing means for selecting the time interval from energization of said timer until generation of the signal by said transistor.

9. The device as set forth in claim 8 including reset means for resetting said timer.

10. An integrated transformer and switch device for controlling the flow of electrical power from a power source to a load, said device comprising:

a. transformer means including a first primary winding means, a second primary winding means and a secondary winding means, said secondary winding means being magnetically coupled to said first and second primary winding means to provide electrical energy pulses upon energization of said first and second winding means;

b. actuatable first switch means for conveying electrical power to the load, said first switch means having a normally closed state for providing electrical power to said first primary winding means and a normally open state for providing electrical power to the load, said first switch means being urged in the normally closed state upon energization of said first primary winding means;

c. second switch means enabled by the electrical energy pulses from said secondary winding means for providing an output signal;

d. third switch means responsive to the output signal from said second switch means for energizing said second primary winding means, said second primary winding means, on energization, providing an emf in opposition to the emf of said first primary winding means to nullify the maintenance of said first switch means in the normally open state and thereby permitting said first switch means to return to the normally closed state;

whereby, the load remains connected to the power source upon actuation of said first switch means until said second switch means provides an output signal.

11. The device as set forth in claim 10 wherein said first switch means includes a relay switch.

12. The device as set forth in claim 11 wherein said third switch means comprises an active element having a conducting state and a non-conducting state.

13. The device as set forth in claim 12 wherein energization of said first primary winding means provides sufficient emf to maintain said first switch means in the normally open state.

14. The device as set forth in claim 13 wherein said active element includes an SCR and a transistor.

15. An integrated transformer and switch device for controlling the flow of electrical power from a power source to a load, said device comprising:

a. transformer means including a primary winding means continually energized by the power source, a control secondary winding means and a secondary winding means, said control secondary winding means being magnetically coupled to said primary winding means to generate a back emf and said secondary winding means being magnetically coupled to said primary winding means to provide electrical energy pulses upon energization of said primary winding means;

b. first switch means for conveying electrical power from the power source to one of two electrical conductors, said first switch means having a normally closed state and a normally open state, said first switch means being maintained in the normally open state during energization of said control secondary winding means;

c. second switch means having a first state in response to energization of said primary winding means for interconnecting the load with one of the two conductors and a second state interconnecting the load with another of the two conductors, said second switch means being responsive to generation to the emf by said primary winding means to maintain said second switch means in the first state;

d. means responsive to the electrical energy pulses provided by said secondary winding means for enabling said control secondary winding means to generate the back emf in opposition to the emf generated by said primary winding means;

whereby, said enabling means nullifies the emf generated by said primary winding means to permit switching of said second switch means from the first state to the second state and connect or disconnect the load through one of the two electrical conductors with the power source, depending upon manner of connection of the two electrical conductors intermediate said first and second switch means.

16. The device as set forth in claim 15 wherein said first switch means comprises a mechanical switch.

17. The device as set forth in claim 16 wherein said second switch means comprises a relay switch.

18. The device as set forth in claim 17 wherein said enabling means comprises a timer for providing an output signal after a predetermined time period and switching means for increasing the current flow through said control secondary winding means to generate sufficient back emf to switch said second switch means to the second state.

19. The device as set forth in claim 18 wherein said switching means comprises an active element.

20. The device as set forth in claim 15 wherein said enabling means comprises a timer for providing an output signal after a predetermined time period and switching means for increasing the current flow through said control secondary winding means to generate sufficient back emf to switch said second switch means to the second state.

21. The device as set forth in claim 20 wherein said switching means comprises an active element.

* * * * *